US007735201B1

(12) United States Patent
Reeves

(10) Patent No.: US 7,735,201 B1
(45) Date of Patent: Jun. 15, 2010

(54) MULTIPLE WIRE CARD WIRING, CARDING CYLINDER, AND METHOD OF MAKING SUCH

(75) Inventor: Carlton L. Reeves, Dundee, NY (US)

(73) Assignee: NV Bekaert SA, Zwevegem (BE)

( * ) Notice: Subject to any disclaimer, the term of this patent is extended or adjusted under 35 U.S.C. 154(b) by 10 days.

(21) Appl. No.: 12/222,284

(22) Filed: Aug. 6, 2008

(51) Int. Cl.
*D01G 15/84* (2006.01)

(52) U.S. Cl. ..... 19/114

(58) Field of Classification Search ..... 19/114; D15/78

See application file for complete search history.

(56) References Cited

U.S. PATENT DOCUMENTS

| | | | | |
|---|---|---|---|---|
| 922,448 | A * | 5/1909 | Bates et al. | 19/114 |
| 4,211,583 | A | 7/1980 | Eadie et al. | |
| 4,398,318 | A | 8/1983 | Ashworth, III | |
| 4,625,367 | A | 12/1986 | Sole-Leris | |
| 4,651,387 | A * | 3/1987 | Giuliani | 19/113 |
| 2006/0156516 | A1 | 7/2006 | Bocht | |

FOREIGN PATENT DOCUMENTS

| | | | |
|---|---|---|---|
| EP | 0 249 706 | A | 12/1987 |
| WO | WO2004/048654 | A | 6/2004 |
| WO | WO2006/128744 | A | 12/2006 |
| WO | WO2007/022659 | A | 3/2007 |

OTHER PUBLICATIONS

Bekaert Carding Solutions NV brochure entitled "Bekaert/Carding solutions for non woven Cards", printed out Jul. 3, 2008 from http://www.bekaert.com/cardingsolutions/uploads/PerPage/Home/BEKAERT_BRO_CARD_NonWov.pdf, undated, Copyright 2005 NV Bekaert SA, (8 pp.).

ATTRA (Appropriate Technology Transfer for Rural Areas) information on "Kenaf Production" dated Jun. 2003, printed out from http://www.attra.orq/attra-pub/PDF/kenaf.pdf, (4 pp.).

PCT International Search Report of PCT/US2009/004382, dated Nov. 9, 2009 (5 pgs.).

PCT Written Opinion of the International Searching Authority of PCT/US2002/004382, dated Nov. 9, 2009 (6 pgs.).

Abstract (English) for EP 0 249 706 A, entitled "Clothing for textile preparation machines, in particular combing machines, carding machines or the like" (one page) from EPO website espacenet.com, undated, downloaded Dec. 28, 2009.

* cited by examiner

*Primary Examiner*—Shaun R Hurley
(74) *Attorney, Agent, or Firm*—Shlesinger, Arkwright & Garvey LLP

(57) ABSTRACT

Card wiring includes a first carding wire including a number of rough, pointed, first teeth, and a second carding wire having smooth, blunt teeth. The rough teeth include a rough surface having a first coefficient of friction, an attack angle, and a back angle. The smooth blunt teeth have a smooth surface including a second coefficient of friction. The first teeth are adjacent to and spaced apart from the second teeth. The first coefficient of friction is sufficiently greater than the second coefficient of friction so that, in use, a fiber engaged by the rough, pointed, first tooth and by the smooth, blunt second tooth will be held sufficiently longer by the first rough tooth so that the fiber will be pulled in a direction transverse to a direction of movement of a web engaged by the first and second carding wires. Three or more carding wires may be provided.

20 Claims, 9 Drawing Sheets

MULTIPLE WIRE CARD WIRING, CARDING CYLINDER, AND METHOD OF MAKING SUCH

FIELD OF THE INVENTION

The invention relates to a carding wire. More specifically, the invention relates to a multiple carding wire card wiring, and a method of making such. Even more particularly, the invention relates to a card wiring having two or more carding wires, and which carding wires are configured for enhancing the characteristics of a fiber material, such as a nonwoven fiber web, processed with the card wiring.

BACKGROUND OF THE INVENTION

Carding is a known process of opening, cleaning, straightening, and aligning fibers.

Known carding processes separate fibers from each other, lays them parallel, and condenses them into singular untwisted bunches or strands. The carding process can be done by hand or by machines. If done by means of machines, the fiber working components are formed either by needles or by saw toothed steel wires known as carding wires or card clothing wires.

It is likewise known to use carding machinery to make nonwoven webs, such as used for the manufacture of disposable wipes, disposable garments, disposable filters, such as hospital masks.

It is also known to process fibers, including the manufacturing of nonwoven webs, on high speed carding machinery of the type which uses cylinders on which carding wires have been wound to form toothed cylinders having hundreds of rows of toothed carding wires having, in total, thousands of teeth.

Such known rollers are termed, for example, main, doffer, randomizer, and condenser rollers.

Known carding wires, and the use thereof in high speed high volume carding machinery, include carding wire manufactured and sold by NV BEKAERT SA, which can be found at http://www.bekaert.com/cardingsolutions/ and www.bekaert.com. BEKAERT carding wire, such as BEKAERT SIROLOCK® brand carding wire, and BEKAERT WEBLOCK® brand carding wire. These are merely two (2) examples of known BEKAERT brand carding wires.

Known patents include:

U.S. Pat. No. 4,398,318 to Ashworth, III, entitled "Card Clothing for Carding Machine Elements"; and U.S. Pat. No. 4,211,583 to Eadie et al., entitled "Card-clothing Wire".

Known carding wires are unsatisfactory for the high speed production of known nonwoven webs, such as used for wipes and disposable garments, as described above.

In high speed production, the higher machine speeds; i.e., line speeds, the known card wiring and carding wires tend to produce nonwoven webs which have diminished strength in a crosswise direction that is crosswise relative to the machine direction of the carding machine during production.

OBJECTS AND SUMMARY OF THE INVENTION

It is an object of the invention to overcome the drawbacks of known carding wires.

It is another object of the invention to overcome the drawbacks of known carding rollers, such as doffer, and randomizer or condenser rollers, and roller doffers or takeoff rollers, as well as drawbacks of known carding machinery and devices.

Another object of the invention is to provide card wiring which processes synthetic and natural fibers at a faster rate during the production of nonwoven webs than known carding wires, and without a reduction in crosswise web strength.

Further, it is an object of the invention to provide card wiring which includes multiple carding wires for enhancing the strength of nonwoven webs, even at increased web production speeds.

It is a further object of the invention to provide enhanced crosswise or cross direction (CD) web strength of the web than in known devices.

Another object of the invention is to provide card wiring which is configured for processing natural fibers such as sisal, white jute (*Corchorus capsularis*), tossa jute (*Corchorus olitorius*), Kenaf (*Hibiscus cannabinus L.*), hemp, cellulose, and other natural fibers.

Still further, it is an object of the invention to provide carding wire and card wiring which processes lyocell, such as TENCEL® brand lyocell, lyocell cotton blends, and lyocell rayon blends better than known carding wires.

Still further, it is an object of the invention to provide a carding wire, as well as card wiring, including two or more types of carding wire, which produces stronger webs of nonwoven material, such as used for hand wipes, hospital gowns, so-called baby wipes, disposable filters, cellulose-based hand wipes, diaper linings, disposable hospital smocks and the like, than known carding wires.

It is a further object of the invention to provide card wiring including at least two types of carding wires having respective tooth roughness characteristics that differ sufficiently from each other so that cross-direction web strength is better than in known devices.

It is a further object of the invention to provide card wiring including at least three types of carding wires having respective tooth roughness characteristics that differ sufficiently from each other so that cross-direction web strength is better than in known devices.

Another object of the invention is to provide a carding machine which overcomes the drawbacks of known devices.

Another object of the invention is to provide a carding roller, such as a condenser, which overcomes the drawbacks of known devices.

A further object of the invention is to provide a card wiring which can be used on a roller, such as a condenser, as well as a flat, stationary or movable carding device of a carding machine, and which overcomes the drawbacks of known devices.

In sum, the inventive card wiring includes a first carding wire including a number of rough, pointed, first teeth, and a second carding wire having smooth, blunt teeth. The rough teeth include a rough surface having a first coefficient of friction, an attack angle, and a back angle. The smooth blunt teeth have a smooth surface including a second coefficient of friction. The first teeth are adjacent to and spaced apart from the second teeth. The first coefficient of friction is sufficiently greater than the second coefficient of friction so that, in use, a fiber engaged by the rough, pointed, first tooth and by the smooth, blunt second tooth will be held sufficiently longer by the first rough tooth so that the fiber will be pulled in a direction transverse to a direction of movement of a web engaged by the first and second carding wires.

The invention further includes the use of three, four, or more carding wires which cooperate to provide the desired nonwoven web strength and web production characteristics.

The invention likewise includes a method of making a multiwire card wiring, and a roller, such as a condenser, or a flat carding device, that use such carding wires, and which can be used on a variety of natural fibers and for increasing the quality and production rates of products made thereby, such as the use of sisal, tossa, jute in the production of the wall coverings of office dividers, the sound deadening material of automotive carpets (such as with card, nonwoven sisal fiber webs), such products being used between a metal floor of an automobile and the automotive carpet itself.

It will be appreciated that relative terms such as up, down, vertical, horizontal, left, and right, are for convenience only and are not intended to be limiting.

DEFINITIONS

Carding wire, as used herein, refers to a carding wire having a plurality of teeth for carding fibers.

Card wiring, as used herein, refers to wiring in the sense of wiring having two or more carding wires or three or more carding wires, or four or more carding wires used in combination. Card wiring is used in the sense of a wiring system, having two, three, four, or more wires, the characteristics of which wires cooperate to yield the desired characteristics for treating (i.e. carding) fibers in the desired manner depending on the end product and production speed, for example.

DETAILED DESCRIPTION OF THE INVENTION

Figure 1:
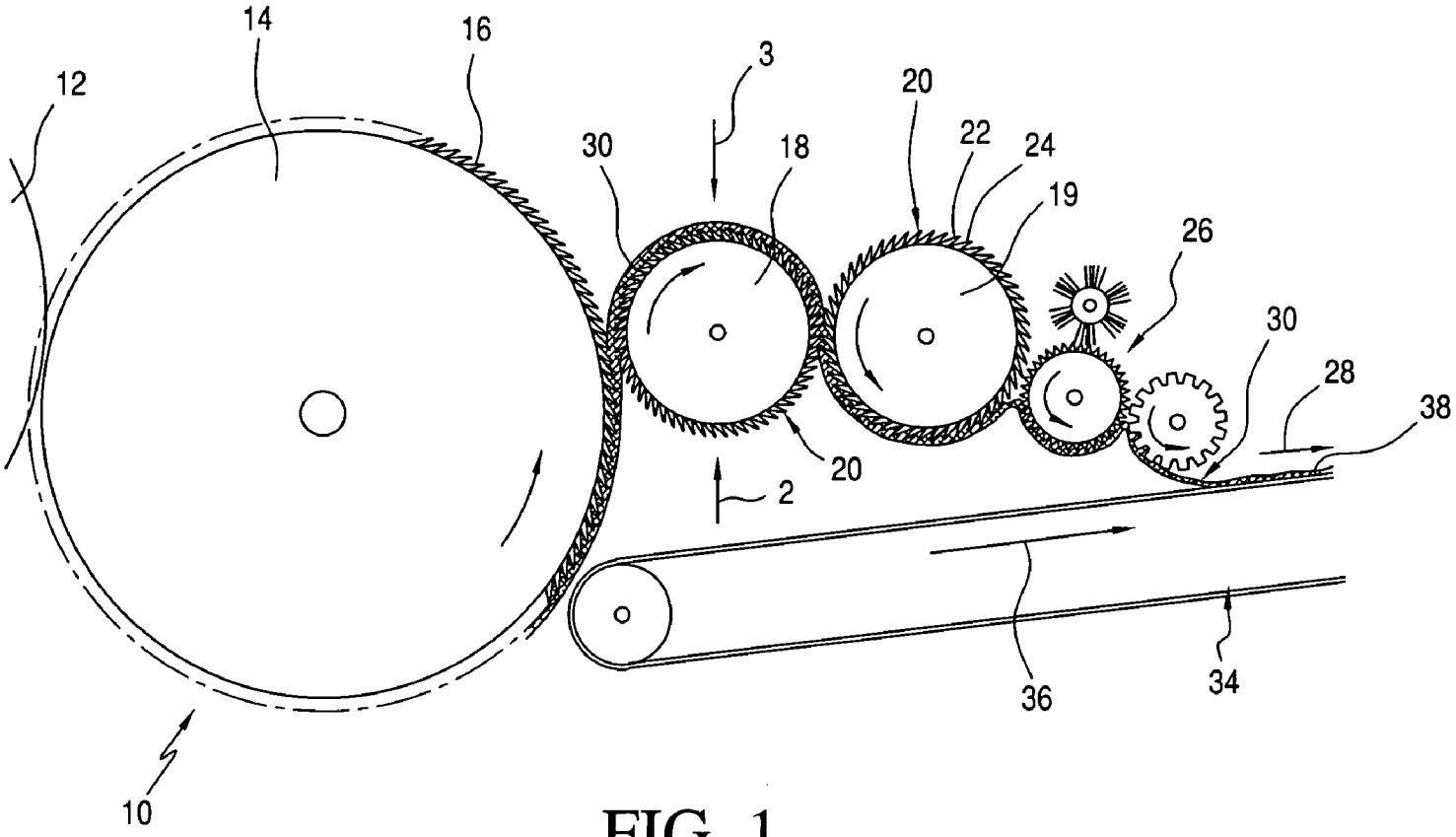
FIG. 1 is a front elevational view of an embodiment of a card wiring according to the invention in use on a carding machine having carding rollers according to the invention, and showing a direction of movement of a nonwoven web of fibers, in use.

FIG. 1 illustrates a carding machine 10 which may be a conventional carding machine having a variety of cylinders and rollers depending on the type of fibers being worked.

As shown in FIG. 1, carding machine 10 may include a main cylinder 12, a doffer 14 with a carding surface 16 in the form of, typically, hundreds of windings of carding wires having rows of carding teeth totaling in the thousands of teeth for carding fibers in conjunction with an adjacent cylinder 18. Cylinder 18 may be termed a randomizer roller or condenser 18, likewise having a carding element 20 on its outer surface, carding element 20 being in the form of a multiple wire card wiring 20, as described in detail below. In brief, card wiring 20 includes a first type of carding wire 22 and a second type of carding wire 24, as shown in greater detail in FIGS. 2-10.

A further randomizer or condenser 19 may be provided adjacent condenser 18. Still further, a roller doffer 26 including one or more rollers, may be provided in a known manner for transferring a web 30, such as a nonwoven web, being produced in a direction 28 on a conveyor 34. A free end 38 of web 30 may be seen extending in the direction of travel 28 of web 30. Reference numeral 36 indicates a direction of conveyance of conveyor 34 as will be readily appreciated.

The rates of rotation, the locations, and numbers of the various cooperating condensers 18 and 19, and other cooperating rollers, relative to doffer 14 may be varied in accordance with the synthetic and natural fibers being processed, as will be readily apparent to a person having ordinary skill in the art.

Figure 2:
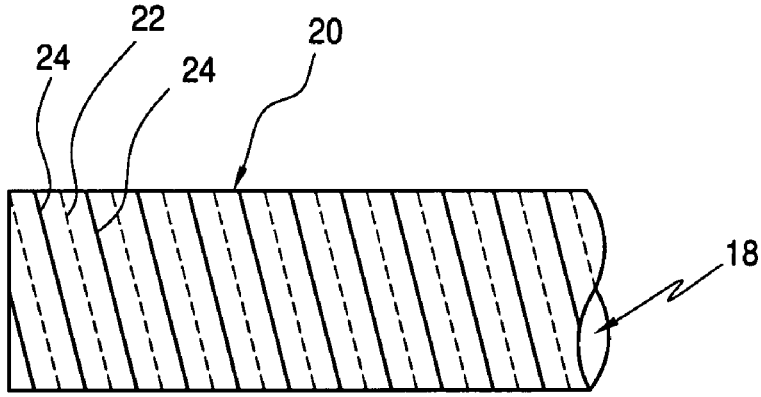
FIG. 2 is a bottom schematic view of the embodiment of the card wiring of FIG. 1 as viewed on a condenser roller of the carding machine in the direction of arrow 2 in FIG. 1.

FIG. 2 is a partial view of condenser 18 showing schematically the alternating rows of toothed carding wires 22 and 24 of card wiring 20. As shown, web 30 will typically not be on an underside of condenser 18 as seen in FIGS. 1 and 2.

Figure 3:
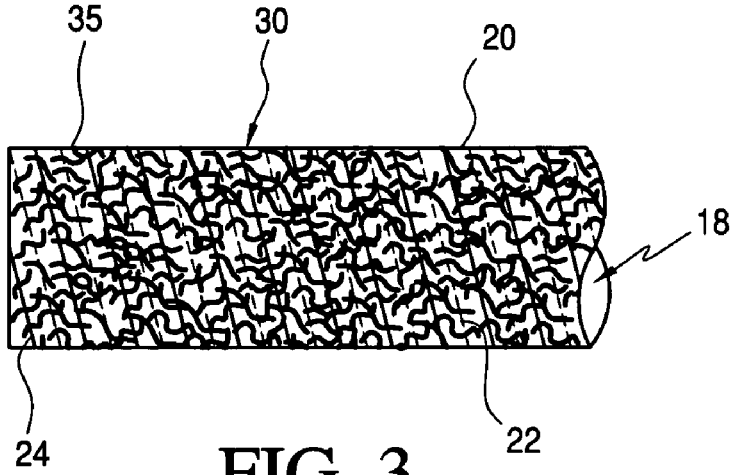
FIG. 3 is a top schematic view of the embodiment of the card wiring of FIG. 1 as viewed on a condenser roller of the carding machine in the direction of arrow 3 in FIG. 1, and showing schematically fibers distributed transversely relative to the direction of movement of the web of fibers, in use.

FIG. 3 is a view similar to FIG. 2, yet showing a top view of condenser 18, as seen in the direction of arrow 3 of FIG. 1. FIG. 3 shows the manner in which each of a plurality of fibers 35 being carded has been distributed randomly, and extends transversely relative to the web direction 28; that is, distributed extending transversely relative to the direction of rotation of condenser 18 of FIG. 1, for example.

Thanks to the configuration of first teeth 22 and second teeth 24, fibers 35 being processed have been distributed transversely relative to the longitudinal direction of non-woven web 30 to a greater extent than in known devices. This enhanced distribution of carded fibers 35 in web 30 relative to the longitudinal direction of web 30 increases the web strength in its cross direction (CD) even at greater production speeds; i.e. web speeds. Web speed may be termed the speed of the web in the machine direction (MD); i.e., the speed at which web 30 is being produced in web travel direction 28. Given that fibers 35 are moved side to side, thanks to the use of different carding wires 22 and 24 having different carding characteristics (e.g., fiber retention and fiber movement characteristics) adjacent to each other, the carding machine 10 using the card wiring according to the invention replaces cross direction (CD) web strength that has been lost at greater web speeds, i.e., machine direction (MD) speeds. In brief, the strength of web 30 has been enhanced given the increase in the ratio of cross direction (CD) of the web versus machine direction (MD); namely, the CD/MD strength is improved as will be readily appreciated. This may be further appreciated by considering FIGS. 4-10, 13, and 14, below, for example.

Figure 4:
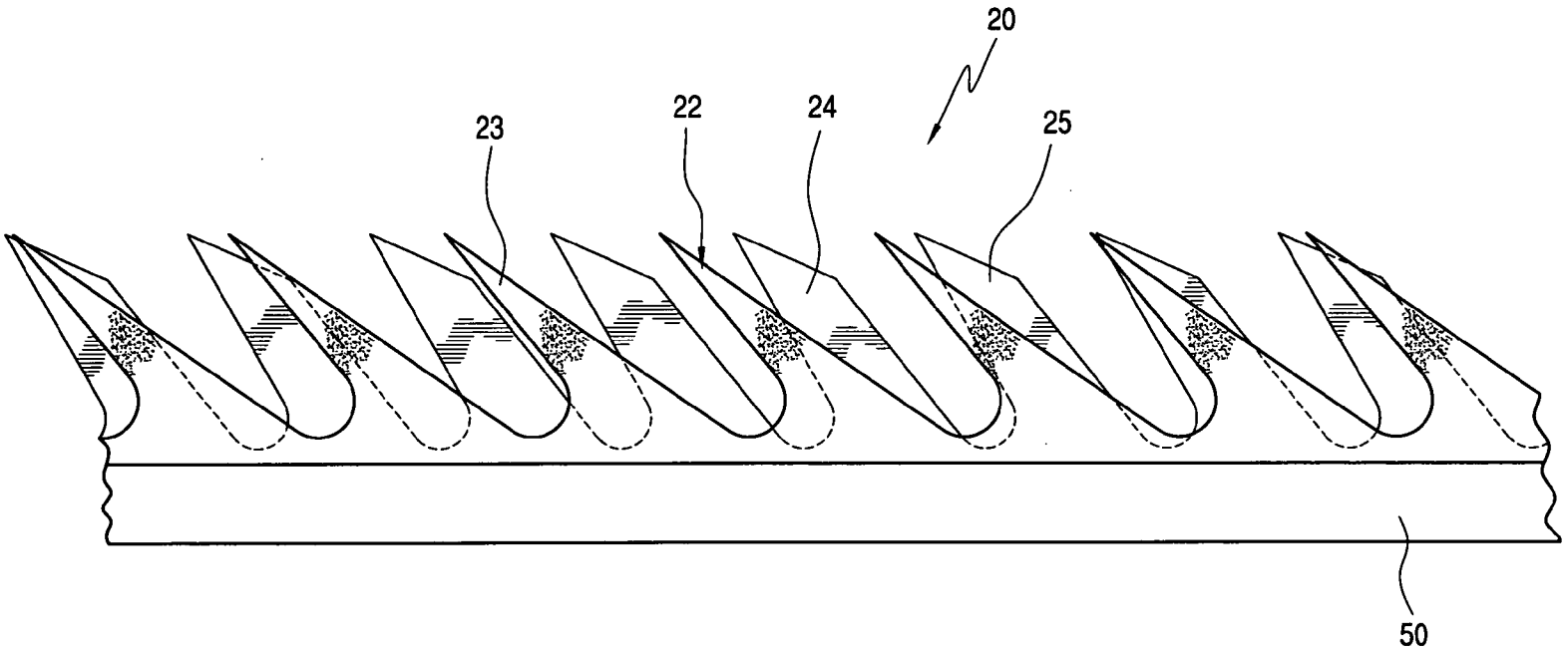
FIG. 4 is an enlarged partial elevational view of the card wiring of the embodiment of FIG. 1 showing the two types of carding wires adjacent each other.

FIG. 4 shows card wiring 20 having first carding wire 22 including a number of rough, pointed teeth 23 on a rib having a face 50, and located adjacent second carding wire 24 having smooth, blunt teeth 25.

Figure 5:
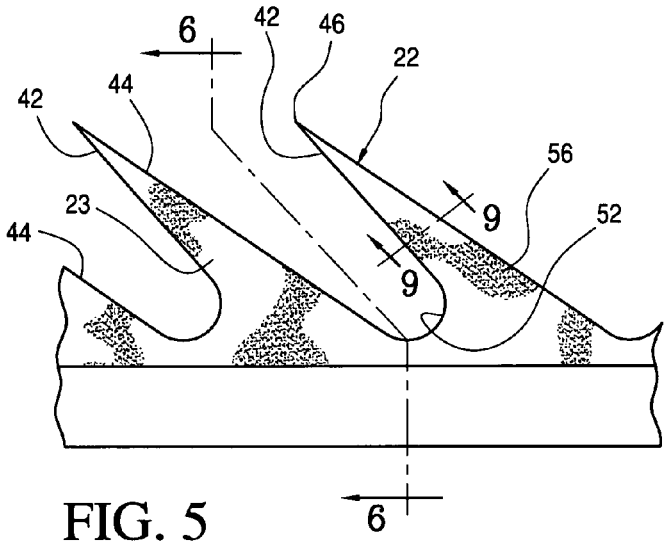
FIG. 5 is an enlarged partial view of pointed, rough teeth of the first type of carding wire of the card wiring of the embodiment of FIG. 1.

More particularly, as shown in FIG. 5, rough, pointed carding wire teeth 23 may include an attack angle 42 and a back angle 44. A tip 46 may be provided at an intersection of attack angle 42 and back angle 44. A throat or radiused portion 52 may be provided between attack angle 42 and back angle 44, and configured to enhance the movement of fibers 35. The desired crosswise, or side-to-side, or transverse movement of fibers 35 across the width of the web 30 is thus achieved. Radiused portion or throat 52 may be provided between back angle 44 and attack angle 42 of adjacent teeth 23.

A rough surface 56 may be provided on teeth 23 to enhance the retention of fibers 35 being carded, in use. Rough surface 56 may be roughened by particle blasting, such as by silica particle blasting, glass particle blasting, or glass bead blasting. The glass particle blasting may be performed sufficiently long to ensure that burrs formed during the process of cutting out the teeth 23 have been removed. Teeth 23 may be formed by being cut with a rotary punch/die, as will be readily appreciated.

Figure 6:
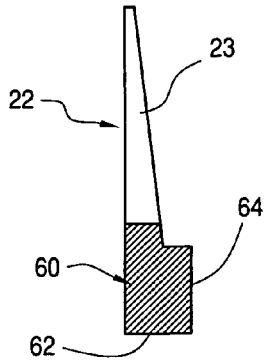
FIG. 6 is a sectional view of the pointed, rough teeth of the carding wire of FIG. 5, taken along line 6-6 in FIG. 5.

FIG. 6 shows a cross-section of carding wire 22 in which a rib 60 having a lower face 62 and a side face 64 is shown. Rib 60 may be provided as the illustrated, substantially rectangular shape, depending on the intended use. Face 64 of rib 60 will abut respective rib 60 of an adjacent carding wire rolled onto condenser 18, condenser 19, and/or doffer 16 of FIG. 1, in use, for example, so as to achieve the desired consistent spacing of the teeth of adjacent carding wires 22 and 24.

Figure 7:
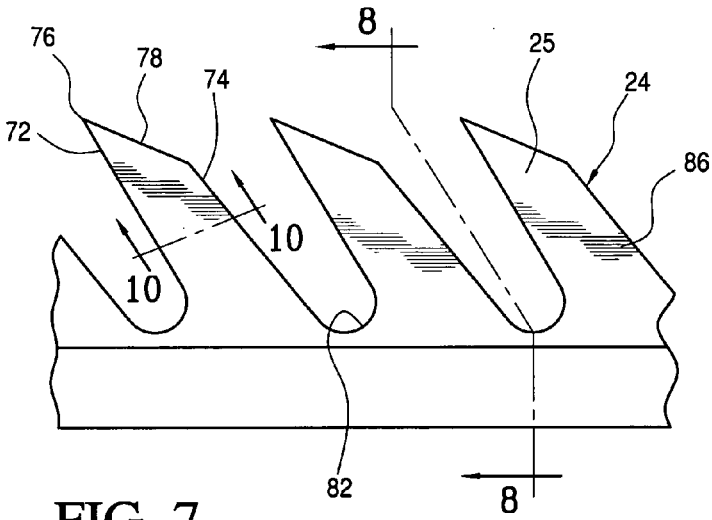
FIG. 7 is an enlarged partial view of smooth, blunt teeth of the second type of carding wire of the card wiring of the embodiment of FIG. 1, shown in a manner similar to FIG. 5.
Figure 8:
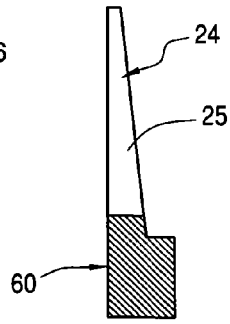
FIG. 8 is a sectional view of the smooth, blunt teeth of the card wiring of FIG. 7, taken along line 8-8 in FIG. 7.

FIGS. 7 and 8 show additional details of carding wire 24, having smooth, blunt teeth 25. Blunt teeth 25 are configured to be substantially smoother than teeth 23, having rough surface 56. In other words, a coefficient of friction of rough surface 56 will be substantially greater than the coefficient of friction of smooth surface 86 of tooth 25, to achieve the desired movement of fibers 35 crosswise relative to the direction of elongation of the web being produced, in use, as explained throughout. Smooth surface may be smoothed by a mechanical process, such as by use of a conventional mechanical grinding wheel.

Further, blunt teeth 25 may include an attack angle 72, a back angle 74, and a secondary back angle 78. Tip 76 may be provided at an intersection of attack angle 72 and secondary back angle 78, as shown. Further, a radiused portion or throat 82 may be provided between attack angle 72 and back angle 74 of adjacent teeth.

FIG. 8 is a cross-sectional view of FIG. 7, showing the provision of rib 64 of carding wire 24, and which rib 64 aligns adjacent carding wires in a desired position relative to each other, as described above in regard to FIG. 6.

Figure 9:
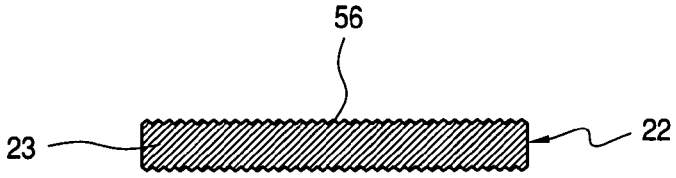
FIG. 9 is a sectional view of the pointed, rough teeth of the carding wire of FIG. 5, taken along line 9-9 in FIG. 5.

FIG. 9 is a cross-sectional view of rough, pointed carding wire 22, taken along line 9-9 of FIG. 5 showing roughened surface 56 of tooth 23.

Figure 10:
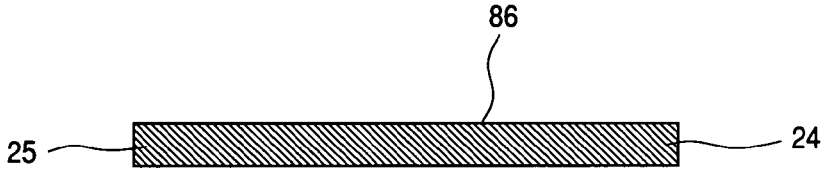
FIG. 10 is a sectional view of the smooth, blunt teeth of the carding wire of FIG. 7, taken along line 10-10 in FIG. 7.

FIG. 10 is a cross-sectional view of carding wire 24, taken along line 10-10 of FIG. 7 showing smooth surface 86 of smooth, blunt tooth 25.

Figure 11:
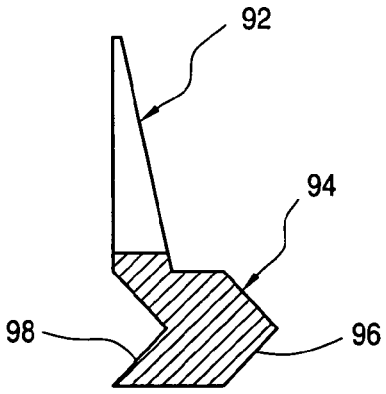
FIG. 11 is a sectional view similar to FIG. 8 of another embodiment of the teeth of the card wiring according to the invention.

FIG. 11 shows another embodiment of a carding wire 92 having a shaped rib 94, showing a V-type shaped rib 94 including an outwardly extending angled face 96 configured for mating with an inwardly extending angled face 98 of an adjacent carding wire 92, and used when wrapped around a carding cylinder as will be readily appreciated.

Figure 12:
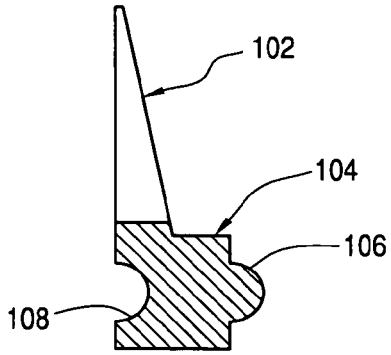
FIG. 12 is a sectional view similar to FIG. 11 of a further embodiment of the teeth of the card wiring according to the invention.

FIG. 12 shows another embodiment of a carding wire 102 having a shaped rib 104, showing a D-type shaped rib 104 including an outwardly extending angled face 106 configured for mating with an inwardly extending angled face 108 of an adjacent carding wire 102, and used when carding wires 102 are wrapped around a carding cylinder as will be readily appreciated.

Figure 13:
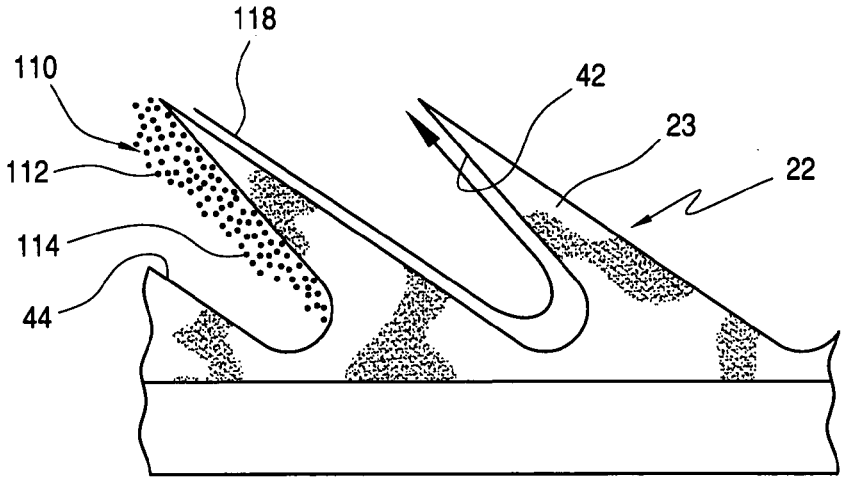
FIG. 13 is a view of the embodiment of the carding wire of FIG. 5 of the card wiring of FIG. 4, in use.

FIG. 13 is a view of carding wire 22, in use, illustrating the manner in which pointed, rough tooth 23 enhances the distribution of a number of fibers 110 crosswise relative to the direction 28 of web 30, in use. Carding wire 22 is shown by itself, in use, for clarity, and it should be noted that carding wire 22 will be adjacent to two other smooth, blunt carding wires 24 when in use, as shown and described above in connection with FIGS. 2, 3, and 4, for example, in which multiple carding wire card wiring 20 is illustrated. Thanks to rough surface 56 of tooth 23, and the configuration of back angle 44 and attack angle 42, fibers 110 collectively, during the carding of web 30, will be distributed in both upper and lower regions substantially adjacent to attack angle 42, as shown by the cross sectional view of the number of fibers 110. It will be appreciated that, in use, in the carding process, the collectively shown fibers 110 (i.e. a number of individual fibers 35 as described in connection with FIG. 3, for example) will be momentarily positioned adjacent tooth 23, as shown. There will be continual movement of fibers 110, as shown by curved arrow 118 schematically illustrating the manner in which fibers 110 being carded, including individual fibers 112 and 114, will be moving during production of the unwoven web 30. Fibers 110 are shown collectively, substantially located predominantly along the face of tooth 23 defined by attack angle 42 in order to illustrate that fibers 110 will remain slightly longer along that face than along the face defined by attack angle 44. Given roughened surface 56 and the aggressive configuration of the pointed teeth 23, the fibers 110 remain sufficiently longer and may be pulled sufficiently greater by roughened, pointed teeth 23 that the fibers are drawn on average crosswise relative to the length of web 30, in use. That is, in use, fibers 110 engaged by teeth 23 are pulled slightly more than and retained slightly longer than fibers 110 as they are concurrently being engaged and retained by teeth 25 of carding wire 24, as will be appreciated from the description of FIG. 14 below, and throughout.

Figure 14:
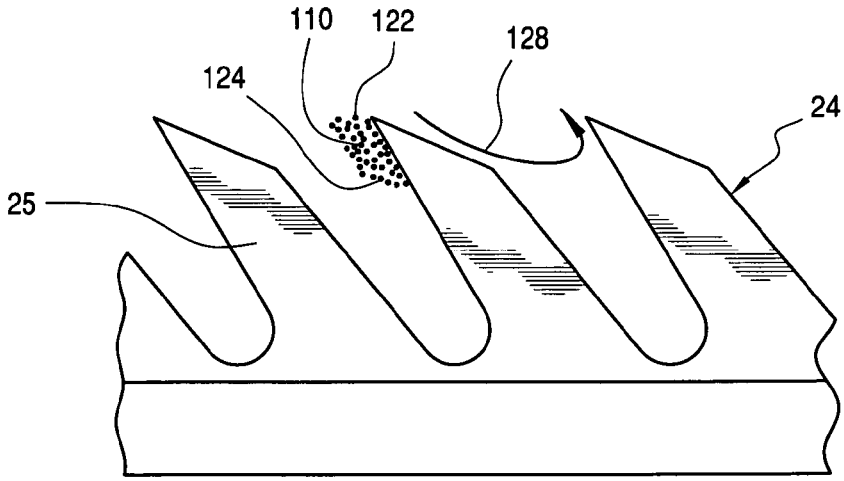
FIG. 14 is a view of the embodiment of the carding wire of FIG. 7 of the card wiring of FIG. 4, in use.

FIG. 14 is a view similar to FIGS. 7 and 4 (and FIG. 13) illustrating the movement of fibers 110 collectively, in use, thanks to the configuration of blunt, smooth teeth 25 of carding wire 24. Fiber 110 movement will be best understood when considering FIG. 14 and its description, and the description of fiber 110 movement immediately following. Fibers 110 include individual fibers 122 near the tip 76 of teeth 25 and further individual fibers 124 further away from tip 76 toward throat 82. Given the blunt configuration of teeth 25, and smooth surface 86, fibers 110 will tend to be continually momentarily retained near the upper portions of teeth 25, as shown.

By considering the manner in which fibers 110 are momentarily retained by pointed, rough teeth 23 of FIG. 13, it will be readily appreciated that fibers 110 collectively have a greater tendency to be retained longer, and be pulled sufficiently greater by teeth 23 which are adjacent to teeth 25 of an adjacent carding wire 24, as shown in FIGS. 2, 3, and 4, in use, thus resulting in the desired overall tendency of individual fibers 35, shown collectively as group of fibers 110, to be pulled and directed crosswise relative to the direction of movement 28 of web 30.

Curved arrow 128 of FIG. 14 shows the manner in which fibers in unwoven web 30 being processed are moved in and out of engagement with upper portions of teeth 25 during processing of web 30, in use. As in FIG. 13, it will be appreciated that the location and movement of fibers are shown herein at a moment in time for explanatory purposes and that the movement of fibers 110 into and out of engagement with teeth 23 and 25 at the relatively high line speeds of carding devices 10 in use is relatively brief, described herein as momentary for convenience.

Given the configuration of carding wires 22 and 24 that causes the desired increased crosswise orientation of fibers in unwoven web 30, even greater line speeds may be achieved than in conventional carding devices.

Figure 15:
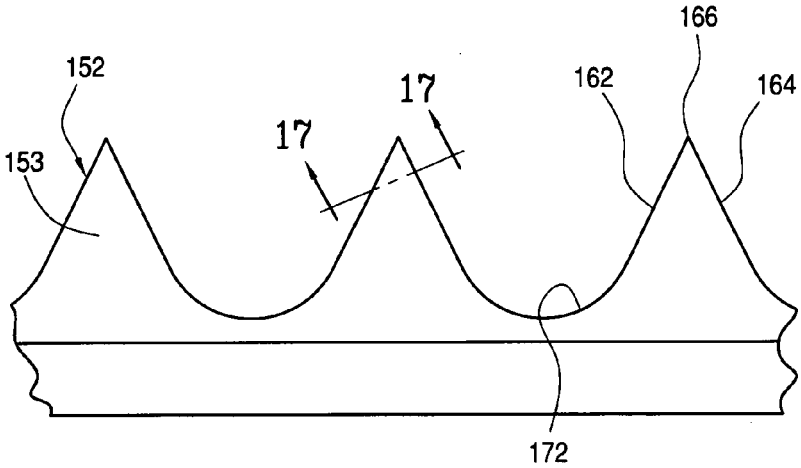
FIG. 15 is an enlarged partial view of neutral, smooth teeth of a further type of carding wire of a further type of card wiring according to the invention.
Figure 16:
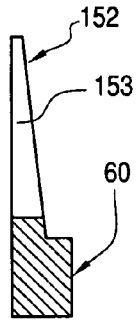
FIG. 16 is a sectional view of the neutral, smooth teeth of the carding wire of FIG. 15, the section being similar to the sections of FIGS. 6 and 8.
Figure 17:
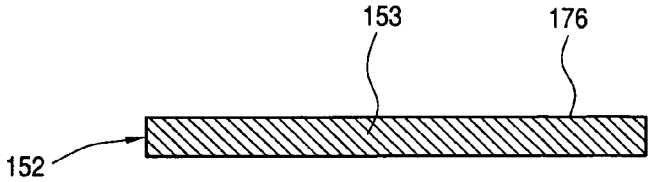
FIG. 17 is an enlarged partial view of the neutral, smooth teeth of the carding wire of FIG. 15, taken along line 17-17 in FIG. 15.

FIGS. 15-17 illustrate yet another embodiment of a carding wire 152 according to the invention.

Carding wire 152 may include teeth 153 having an attack angle 162 and a back angle 164. A tip 166 may be defined by an intersection of attack angle 162 and back angle 164. Further, a radiused portion or throat 172 may be provided, such as between back angle 164 and attack angle 162 of adjacent teeth. Attack angle 162 and back angle 164 may be selected so that, in use, tooth 153 may be considered a neutral tooth. That is, so that, in use fibers engaged by tooth 153 are substantially as likely to be distributed on the side of the tooth defined by attack angle 162 as on the side of the tooth defined by back angle 164. This is as compared to teeth 23 which are configured to cause the fibers, in use, to be predominantly on the attack angle side of tooth 23; hence, teeth 23 are not "neutral". Teeth 25 are likewise not neutral, even though the fiber retention characteristics differ from the teeth 23. That feature of teeth 153 being neutral will likewise be understood when considering additional details of the embodiment of tooth 153, and its manner of use, set forth in the description of FIGS. 16-20 below.

FIG. 16 illustrates a cross-sectional view, similar to FIGS. 6 and 8, of tooth 153 of FIG. 15. Rib 60, described above, may be provided to achieve the desired spacing of adjacent carding wires, in use, as will be readily appreciated, and as described above.

FIG. 17 is a cross-sectional view taken along line 17-17 of FIG. 15, and illustrates a smooth surface 176 provided on tooth 153 of carding wire 152. Smooth surface 176 may be made even smoother than surface 86 of blunt, smooth tooth 25, depending on the intended use. The smooth surface 176 may be made smother such as by use of a known acid wash for removing even more metal burrs left from the step of cutting out teeth 153 of carding wire 152 by die cutting, the known acid wash may be, for example, a known Bekaert Carding Solutions chemical treatment. Thus, smooth surface 176 of third carding wire teeth 153 may include an acid washed deburred smooth surface.

Figure 18A:
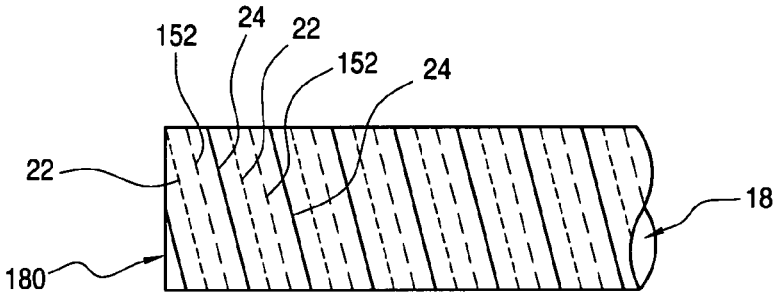
FIG. 18A is a bottom schematic view of the embodiment of the carding wire of FIG. 15, being used in a further card wiring according to the invention in which the carding wire of FIGS. 5, 7, and 15 are part of a three (3) wire card wiring, and as viewed on a condenser roller, for example, of a carding machine and viewed in the same manner and direction of the view of FIG. 2.

FIG. 18A shows a manner in which carding wire 152, having teeth 153, may be used on condenser cylinder 18. As shown, carding wire 152 may be used in conjunction with carding wires 22 and 24 described above. As shown, carding wire 152 may be provided between some of carding wires 22 and 24, to achieve a triple (i.e., three (3) carding wire) card wiring 180 of FIG. 18, in which carding wires 22 and 24 are provided on condenser 18 in use, and with carding wire 152 provided between some of the pairs of carding wires 22 and 24. In this manner, the illustrated carding wires are provided on doffer 18 as follows, in sequence: carding wire 22 is adjacent to carding wire 152, which carding wire 152 is adjacent to carding wire 24, which carding wire 24 is adjacent to carding wire 22, which carding wire 22 is adjacent to carding wire 152, and so forth; quite simply, the carding wire sequence is: 22, 152, 24, 22,152,24,22,152,24, and so forth. In use, one could use three rolls of the three types of carding wire 22, 24, and 152 to cover condenser 18 with card wiring 180 by attaching a free end of each one of wires 22, 24, and 152 adjacent to each other. In that manner, the user could wrap the three different wires 22, 24, and 152 around condenser 18 to yield the three wire card wiring 180 shown on FIG. 18A.

Figure 18B:
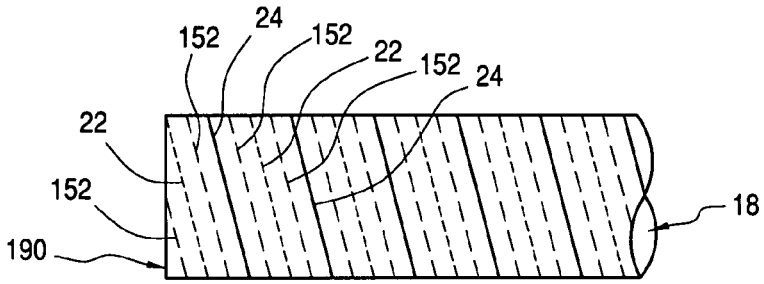
FIG. 18B is a bottom schematic view of the embodiment of the carding wire of FIG. 15, being used in a still further card wiring according to the invention in which the carding wire of FIGS. 5, 7, and 15 are part of a four (4) wire card wiring, and as viewed on a condenser roller, for example, of a carding machine and viewed in the same manner and direction of the view of FIG. 18A.

As shown in FIG. 18B, it is further contemplated that neutral carding wires 152 be located between each occurrence of carding wires 22 and 24, so that card wiring arrangement 190 of carding wires 22, 24, and 152 on condenser 18 is as follows: carding wire 22, then carding wire 152 adjacent to carding wire 22, then carding wire 24 adjacent to wire 152, then carding wire 24 adjacent to wire 152, then carding wire 152 adjacent to wire 24, then carding wire 22, then wire 152, then carding wire 24, and so forth. Quite simply, a carding wire sequence would be as follows: 22, 152, 24,152, 22, 152, 24,152, 22, 152, 24,152, and so forth. Thus, carding wire 152 having neutral teeth 153 would be provided between adjacent windings of carding wires 22 and 24 so that a wire having neutral teeth 153 is always located between rows of rough, pointed teeth 23 and dull, smooth teeth 25.

In use, one could use four (4) rolls of carding wire to wrap around a condenser 18 to yield the desired sequence of card wiring 190. That is, a roll of wire 22, a roll of wire 24, and two (2) rolls of wire 152. Then, free ends of each one of the four (4) rolls may be joined together, such as by soldering, and the four rolls could be unrolled and the carding wire on each could be concurrently wrapped around condenser 18, as will be readily appreciated.

Figure 19:
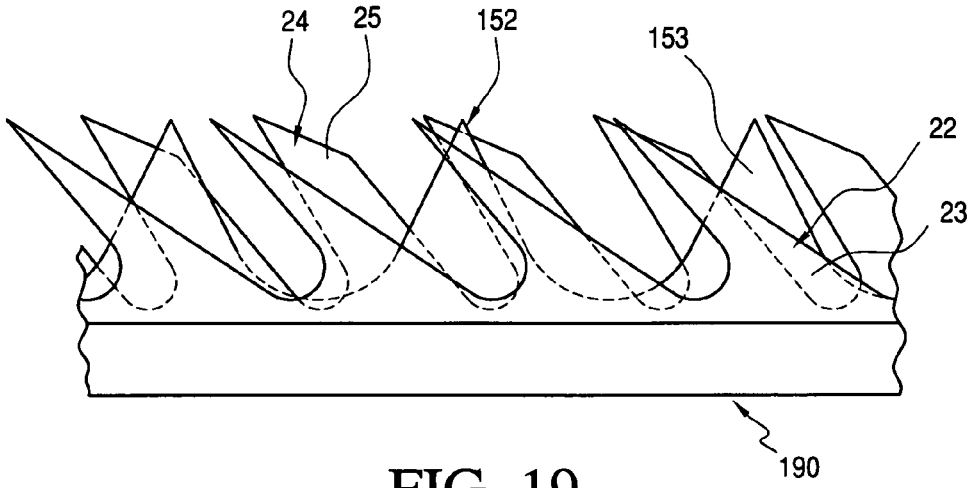
FIG. 19 is an enlarged partial elevational view of the carding wire of the further embodiment of FIG. 15, as used in the three (3) wire card wiring of the embodiment of FIG. 18A showing the three (3) types of carding wires adjacent each other in a manner similar to the view of FIG. 4.

FIG. 19 shows, in a manner similar to FIG. 4, an enlarged view of card wiring 190 illustrating carding wire 152 located between each pair of adjacent ones of carding wire 22 and carding wire 24. As will be appreciated, this sequence appears also as a part of the embodiment of card wiring 180 of FIG. 18A.

Figure 20:
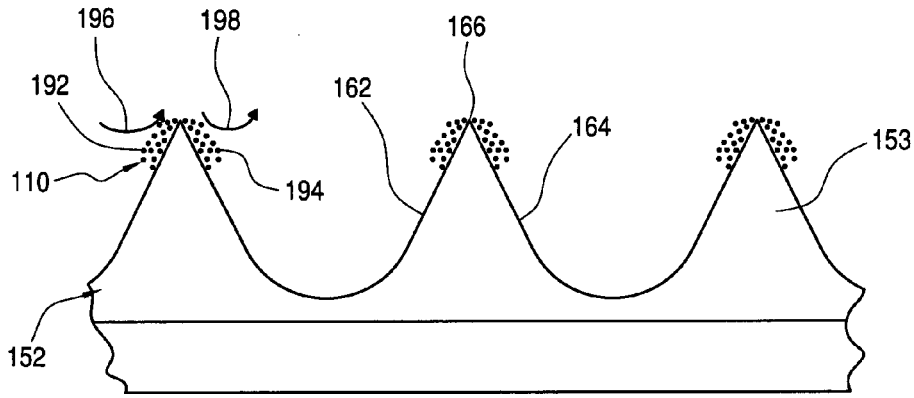
FIG. 20 is a view of the embodiment of the carding wire of FIG. 15, in use.

FIG. 20 illustrates, in a manner similar to FIGS. 13 and 14 described above, the manner in which carding wire 152 influences the movement of groups of fibers 110 thanks to teeth 153 of wiring 152, in use. The tooth 153 configuration being "neutral" will be readily appreciated.

As shown, given the configuration of teeth 153 and its attack angle 162 and 164, fibers 110, on average, will be distributed substantially equally on the faces of teeth 153 defined by attack angle 162 and back angle 164, as shown. Specifically, fibers 192 on an upper part of teeth 153 adjacent attack angle 162 will be moved in a direction as shown by an arrow 196 and, indeed, at an upper portion of tooth 153. In a like manner, fibers 194 will likewise be temporarily adjacent back angle 164, and will move, in use, as shown schematically by an arrow 198. In this manner, a desired cross-sectional flow and, hence, alignment of many of the fibers of web 30 during movement of web 30 in direction 28 of FIG. 1 will be in a crosswise direction of web 30, as schematically shown in FIG. 3.

It will be further appreciated that card wiring 180 of FIG. 18A and the card wiring 190 of FIG. 18B will be provided on condenser 18 depending on the fibers being processed, the type of web being produced, and the like.

It has thus been seen that the provision of pointed, rough teeth on carding wires, that penetrate more deeply into fibers being carded than adjacent blunt, smoother teeth on adjacent carding wires tend to "take" fibers from the blunter, smoother less penetrating teeth, so as to achieve the desired crosswise movement of fibers across the width of a nonwoven web in production, and achieve the desired increased web strength in a crosswise direction even at higher line speeds.

The card wiring embodiments according to the invention may achieve the object of increased web strength, line speed, and without varying the fiber content. Conventional web speeds; i.e., line speeds of 180 m/min. may be increased to 220 m/min., and as much as 250 m/min. in other words, an increased MD/CD ratio has been achieved without a loss in cross-web strength.

Thus, a higher line speed may be achieved while maintaining a desired combination of fibers including non-cotton fibers and cotton fibers to achieve a desired cotton fiber content in a wipe, such as a disposable wipe. For example, 15% cotton content which is required in order to use a desired cotton labeling.

Examples of carding wire used for a card wiring of FIGS. 2 and 4 include:

An example of the pointed, rough wire 22:

Bekaert P100/3.60/50 F3 wire, and F3 being the rough, glass/silica blasted surface 56 described above, and having a rib width (i.e., width of face 62) of 1.0 mm, a height (i.e., an overall height) of 5.0 mm, a heel height (i.e., a height of face 64) of 1.30 mm, a pitch between adjacent tips 46 of 3.6, an attack angle 42 of 50 degrees, and a back angle 44 of 35 degrees.

An example of the blunt, smooth wire 24:

Bekaert L9S/100/F4 wire, and F4 being the mechanically smoothed smooth surface 86 described above, mechanically polished by particle abrasive wheels, and having a rib width of 1.0 mm, a height of 5.0 mm, a heel height of 1.30 mm, a pitch between adjacent tips 76 of 3.0, a double cut back angle, the back angle 74 being 51 degrees, and the secondary back angle 78 of 23 degrees.

The rib width may be in the range of about 0.8-1.8 mm.

The attack angles may be in the range of about 45-90 degrees. The back angle may be in the range of about 25-55 degrees. The height may be in the range of about 3.7-6.0 mm. The secondary back angle may be in the range of about 13-23 degrees. The pitch may be in the range of about 1.8-5.0 mm.

Surface roughness measurements were performed in accordance with accepted test of standard parameters of roughness performed at a traversing speed of 0.5 mm/sec, and four (4) measurements were made for each tooth surface, to determine the following parameters: Ra, Rz, Rt, and Rdq.

Rt defines the maximum peak to valley height in the profile evaluation length;

Ra is the arithmetic mean of the departures of the profile from the mean line and is defined over one sampling length;

Rz defines the maximum peak to valley height within the sample length; and

Rdq is the root mean square value of the ordinate slopes dz/dx with the sampling length.

F3 is the rougher surface 56 and F4 is the smoother surface 86 described above. The following results reflect the average of the four measurements [all measurements are in micrometers or microns (μm), except Rdq which is dimensionless]:

For F3:

Ra was about 0.3088 μm; i.e., about 0.3 μm;

Rt was about 3.2256 μm; i.e., about 3.2 μm;

Rz was about 1.8624 μm; i.e., about 1.9 μm; and

Rdq was about 10.951.

For F4:

Ra was about 0.1010 μm; i.e., about 0.1 μm;

Rt was about 1.0256 μm; i.e., about 1.0 μm;

Rz was about 0.6019 μm; i.e., about 0.6 μm; and

Rdq was about 3.764.

An example of the neutral, smooth third wire 152:

The attack angle of the third neutral teeth may be about 120 degrees, the back angle of the third neutral teeth being about 60 degrees. The attack angle may be 117 degrees with the back angle being 63 degrees. The roughness coefficient of the third tooth smooth surface may be less than that of the second, blunt teeth smooth surface.

It is further contemplated that the invention may be used in the nonwoven manufacturing of hydro entangle webs known as "Spun Lace".

For completeness, carding wire may be made as follows, and roughness coefficients follow below:

Carding wire can be made as follows.

Starting product is a wire rod (usual diameters 5.5 mm or 6.5 mm) with a steel composition along the following lines (in weight percent):

- a carbon content ranging from 0.30% to 2.0%, e.g. from 0.5 to 1.2%; e.g. from 0.6 to 1.1%;
- a silicon content ranging from 0.10% to 2.5%, e.g. from 0.15 to 1.60%;
- a manganese content ranging from 0.10% to 2.0%, e.g. from 0.50 to 0.90%;
- a chromium content ranging from 0.0% to 2.0%, e.g. from 0.10% to 1.50%; e.g. from 0.10% to 0.90%;
- a vanadium content ranging from 0.0% to 2.0%, e.g. from 0.05% to 0.60%, e.g. from 0.10% to 0.50%;
- a tungsten content ranging from 0.0% to 1.5%, e.g. from 0.1% to 0.70%.

In some compositions either chromium or vanadium is present. In some other compositions both chromium and vanadium are present. The amounts of sulfur and phosphorous are preferably kept as low as possible, e.g. both below 0.05%, e.g. below 0.025%.

The wire rod is cold and dry drawn until the desired non-round profile is reached. Rolling can be carried out with Turks heads or rolls. Drawing can be done with profile drawing dies, configured depending upon the application as square, rectangular, or L-shaped. The basis leg of the L forms the foot and the top leg of the L will accommodate the eventual teeth.

After profiling, the teeth are formed in the profile wire by a laser operation, a cutting operation, or a punching operation. The teeth may have various configurations and pitches, depending upon the end use. The forming of the teeth may be followed by a deburring operation as described above.

Thereafter the formed toothed wire is subjected to heat treatment, which provides stress-relief of the foot of the toothed wire and hardening of the teeth. Therefore, the entire toothed wire is heated to a temperature of about 600° C. and the teeth are further heated until they reach a temperature of about 900° C. Thereafter the entire wire is quenched so that the foot is stress-relieved and the teeth are hardened since the teeth are subjected to a greater jump in temperature.

The global heating up to 600° C. is done by induction heating or by use of a gas burner. Heating of the teeth until 900° C. can be done by an additional gas burner, or by passing the teeth through a plasma arc or torch. The quenching operation can be done in an oil bath or in a bath of polymers.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Card wiring, comprising:

a) a first carding wire including a number of rough, pointed, first teeth;

b) the rough teeth including a rough surface having a first coefficient of friction;

c) the first rough teeth including an attack angle and a back angle;

d) a second carding wire provided adjacent to the first carding wire;

e) the second carding wire including a number of smooth blunt teeth having a smooth surface including a second coefficient of friction;

f) the blunt, smooth teeth including an attack angle, a back angle, and a secondary back angle;

g) the first teeth are adjacent to and spaced apart from the second teeth; and h) the first coefficient of friction being sufficiently greater than the second coefficient of friction so that, in use, a fiber engaged by a rough, pointed, first tooth and by a smooth, blunt second tooth will be held sufficiently longer by the first rough tooth so that the fiber will be pulled in a direction transverse to a direction of movement of a web engaged by the first and second carding wires.

2. Card wiring as in claim 1, wherein:

a) the rough, pointed first teeth including a tip, the tip being at an intersection of the attack angle and the back angle; and b) the blunt, smooth teeth including a tip, the tip being at an intersection of the attack angle and the secondary back angle.

3. Card wiring as in claim 2, wherein:

a) the rough surface having a roughness parameter Ra and Rz, and Ra is about 0.3 μm and Rz is about 1.9 μm; and b) the smooth surface having a roughness parameter Ra and Rz, and Ra is about 0.1 μm and Rz is about 0.6 μm.

4. Card wiring as in claim 1, wherein:

a) the rough surface having a roughness parameter Ra and Rz, and Ra is about 0.3 μm and Rz is about 1.9 μm; and b) the smooth surface having a roughness parameter Ra and Rz, and Ra is about 0.1 μm and Rz is about 0.6 μm.

5. Card wiring as in claim 4, wherein:

a) the rough surface is one of a silica-blasted and a glass-blasted surface.

6. Card wiring as in claim 3, wherein:

a) the rough surface is one of a silica-blasted and a glass-blasted surface.

7. Card wiring as in claim 1, wherein:

a) the rough surface is one of a silica-blasted and a glass-blasted surface.

8. Card wiring as in claim 7, wherein:

a) the smooth surface includes a mechanically polished smooth surface.

9. Card wiring as in claim 1, wherein:

a) the attack angles of the blunt teeth are in the range of about 45 to 90 degrees;

b) the back angles of the blunt teeth are in the range of about 25 to 55 degrees; and c) the secondary back angle of the blunt teeth is in the range of about 13 to 23 degrees.

10. Card wiring as in claim 9, wherein:

a) the attack angle of the rough, pointed teeth is about 60 degrees and the back angle of the rough teeth is about 55 degrees; and b) the attack angle of the blunt teeth is about 50 degrees, the back angle is about 51 degrees, and the secondary back angle is about 25 degrees.

11. Card wiring as in claim 2, wherein:

a) a pitch of the rough, pointed teeth is a distance between the tips of adjacent ones of the rough, pointed teeth, and the pitch is about 1.8 to 5.0 mm; and b) the pitch of the smooth blunt teeth is a distance between the tips of adjacent teeth, and the pitch is about 1.8 to 5.0 mm; and c) the height of the pointed teeth and the blunt teeth is about 3.7 to 6.0 mm.

12. Card wiring as in claim 1, wherein:

a) a third carding wire is provided adjacent to the first carding wire;

b) the third carding wire including a number of smooth blunt teeth having a smooth surface including a third coefficient of friction;

c) the third teeth are adjacent to and spaced apart from the first and the second teeth; and d) the second coefficient of friction being sufficiently greater than the third coefficient of friction so that, in use, a fiber engaged by the rough, pointed, first tooth and by a smooth, blunt second tooth will be held sufficiently longer by the first rough tooth than by the third tooth so that the fiber will be pulled in a direction transverse to a direction of movement of a web engaged by the first, second, and third carding wires.

13. Card wiring as in claim 1, wherein:

a) a third carding wire is provided adjacent to the first carding wire;

b) the third carding wire includes a number of neutral teeth having an attack angle and a back angle, and having a smooth surface;

c) the third teeth are adjacent to and spaced apart from the first and the second teeth; and d) the third neutral teeth are configured so that, in use, a fiber engaged by the third neutral teeth will be substantially as likely to be engaged by the attack angle as by the back angle.

14. Card wiring as in claim 13, wherein:

a) the attack angle of the third neutral teeth being about 120 degrees, and the back angle of the third neutral teeth being about 60 degrees.

15. Card wiring as in claim 14, wherein:

a) the attack angle of the third neutral teeth being 117 degrees, and the back angle of the third neutral teeth being 63 degrees.

16. Card wiring as in claim 12, wherein:

a) the smooth surface of the third carding wire includes an acid washed deburred smooth surface.

17. A carding roller comprising the card wiring of claim 12.

18. A carding roller comprising the card wiring of claim 1.

19. A carding roller as in claim 18, wherein:

a) the roller includes a condenser.

20. Card wiring as in claim 13, wherein:

a) the attack angle of the third neutral teeth being about 117 degrees, and the back angle of the third neutral teeth being about 63 degrees.

* * * * *